US007891438B2

(12) United States Patent
Ullrich et al.

(10) Patent No.: US 7,891,438 B2
(45) Date of Patent: Feb. 22, 2011

(54) HAND POWER TOOL

(75) Inventors: Andre Ullrich, Filderstadt-Bernhausen (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 108 days.

(21) Appl. No.: 12/036,413

(22) Filed: Feb. 25, 2008

(65) Prior Publication Data

US 2008/0210448 A1 Sep. 4, 2008

(30) Foreign Application Priority Data

Mar. 2, 2007 (DE) ..... 10 2007 010 180

(51) Int. Cl.
*B25D 9/04* (2006.01)

(52) U.S. Cl. ..... 173/48; 173/29; 173/170; 173/171

(58) Field of Classification Search ..... 173/48, 173/213, 216, 170, 171, 29
See application file for complete search history.

(56) References Cited

U.S. PATENT DOCUMENTS 3,789,933 A * 2/1974 Jarecki ..... 173/48
3,834,468 A * 9/1974 Hettich et al. ..... 173/48
3,866,692 A * 2/1975 Stelljes ..... 173/48
3,955,628 A * 5/1976 Grozinger et al. ..... 173/13
4,158,970 A * 6/1979 Laughon ..... 74/526
4,506,743 A * 3/1985 Grossmann ..... 173/48
5,111,889 A * 5/1992 Neumaier ..... 173/48
5,320,177 A * 6/1994 Shibata et al. ..... 173/48
5,687,834 A * 11/1997 Simon et al. ..... 200/336
5,842,527 A * 12/1998 Arakawa et al. ..... 173/48
5,843,527 A * 12/1998 Sanada ..... 427/240
6,176,321 B1 * 1/2001 Arakawa et al. ..... 173/48
6,423,912 B1 * 7/2002 Arenz et al. ..... 200/43.08
6,789,630 B2 * 9/2004 Quirijnen et al. ..... 173/48

* cited by examiner

*Primary Examiner*—Scott A. Smith
(74) *Attorney, Agent, or Firm*—Michael J. Striker

(57) ABSTRACT

A hand power tool, in particular a drill hammer and/or chisel hammer, has a housing, a first joining unit, and a switch device that has an actuating unit with a second joining unit corresponding to the first joining unit, the actuating unit being capable of being introduced without tools, by the second joining unit, into the first joining unit in a mounting position. The first joining unit and the second joining unit of the actuating unit are provided to perform protection of the actuating unit against being lost, in an installed state of the actuating unit.

12 Claims, 3 Drawing Sheets

HAND POWER TOOL

CROSS-REFERENCE TO A RELATED APPLICATION

The invention described and claimed hereinbelow is also described in German Patent Application DE 102007010180.7 filed on Mar. 2, 2007. This German Patent Application, whose subject matter is incorporated here by reference, provides the basis for a claim of priority of invention under 35 U.S.C. 119(a)-(d).

BACKGROUND OF THE INVENTION

The invention is based on a hand power tool.

A hand power tool is already known that has a housing, a first joining unit, and a switch device with an actuating unit and with a second joining unit, corresponding to the first joining unit. The actuating unit can be inserted into the first joining unit in a mounting position without tools, by means of the second joining unit.

SUMMARY OF THE INVENTION

The invention is based on a hand power tool, in particular a drill hammer and/or chisel hammer, having a housing, a first joining unit, and a switch device that has an actuating unit with a second joining unit corresponding to the first joining unit, the actuating unit being capable of being introduced without tools, by means of the second joining unit, into the first joining unit in a mounting position.

It is proposed that the first joining unit and the second joining unit of the actuating unit are provided to perform protection of the actuating unit against being lost, in an installed state of the actuating unit. In this connection, the term "protection against being lost" should be understood to mean an arrangement of the actuating unit by means of the two joining units on the hand power tool that secures the actuating unit against being detached or removed without tools. The term "mounting position" should be understood in particular to mean a position that is intended solely for installation or removal of the actuating unit and that differs from at least one further switching position of the actuating unit.

In the embodiment according to the invention, an especially advantageous combination of the actuating unit and/or the second joining unit with the first joining unit can be attained that while economizing on further components can advantageously secure the actuating unit against falling out and against being detached from the first joining unit without tools. The first joining unit can be located directly on the housing of the hand power tool or indirectly on an additional component that is integrated with the housing, such as a housing baffle.

Especially advantageously, tool-free removal from the housing can be prevented if the joining units have at least one locking unit, which is intended, in at least one further switching position of the actuating unit differing from its mounting position, for securing the actuating unit against moving into the mounting position. However, it is also conceivable to bring about removal of the actuating unit from the housing using a tool. Advantageously, at least two defined switching positions of the actuating unit that are different from the mounting position are attained by means of the two joining contours.

It is further provided that the locking unit has at least one locking element, which is embodied in boltlike fashion, as a result of which especially stable securing of the actuating unit in a switching position can advantageously be achieved, in particular by means of a detent connection of the boltlike locking element to a further component. The boltlike locking element can be located on the first joining unit and/or on the second joining unit.

In a further feature of the invention, it is proposed that the locking unit has at least one locking element, which is elastically deflectable, as a result of which at least one switching position can be secured especially advantageously against unwanted shifting to a further switching position. The term "an elastically deflectable locking element" should be understood in particular to mean a locking element that, for attaining snapping into a switching position, is elastically deformable in at least one direction, such as a spring and/or other locking elements that appear appropriate to one skilled in the art. The elastically deflectable locking element may be embodied in one piece with the boltlike locking element.

If the locking unit has at least one locking element which is embodied in ramplike fashion, then snapping a further component on the locking element and hence advantageous protection against loss of the actuating unit can be attained structurally simply. The term "ramplike" should be understood here in particular to mean a feature of the locking element with an oblique face, in particular a detent chamfer for attaining a detent connection to a further component. The ramplike locking element may be embodied in one piece with the boltlike locking element and/or with the elastically deflectable locking element.

In an advantageous refinement of the invention, it is proposed that the locking unit has at least one stop means, which is provided for locking the actuating unit in at least one switching position, as a result of which a precise adjustment of at least one switching position can be attained. Advantageously, the locking unit has one stop means for each switching position of the switch unit. The term "locking" should be understood in particular to mean a limitation of a motion, in particular a rotary motion, of the actuating unit in at least one direction.

Additional components, installation space, assembly effort and cost can furthermore advantageously be saved if the stop means and at least one locking element are embodied in one piece.

Especially advantageous force transmission and in particular easy operation of the hand power tool by a user can be attained if the actuating unit has a twist knob.

Further advantages will become apparent from the ensuing description of the drawings. In the drawings, exemplary embodiments of the invention are shown. The drawings, description and claims include numerous characteristics in combination. One skilled in the art will expediently consider the characteristics individually as well and put them together to make appropriate further combinations.

DESCRIPTION OF THE PREFERRED EMBODIMENTS

Figure 1:
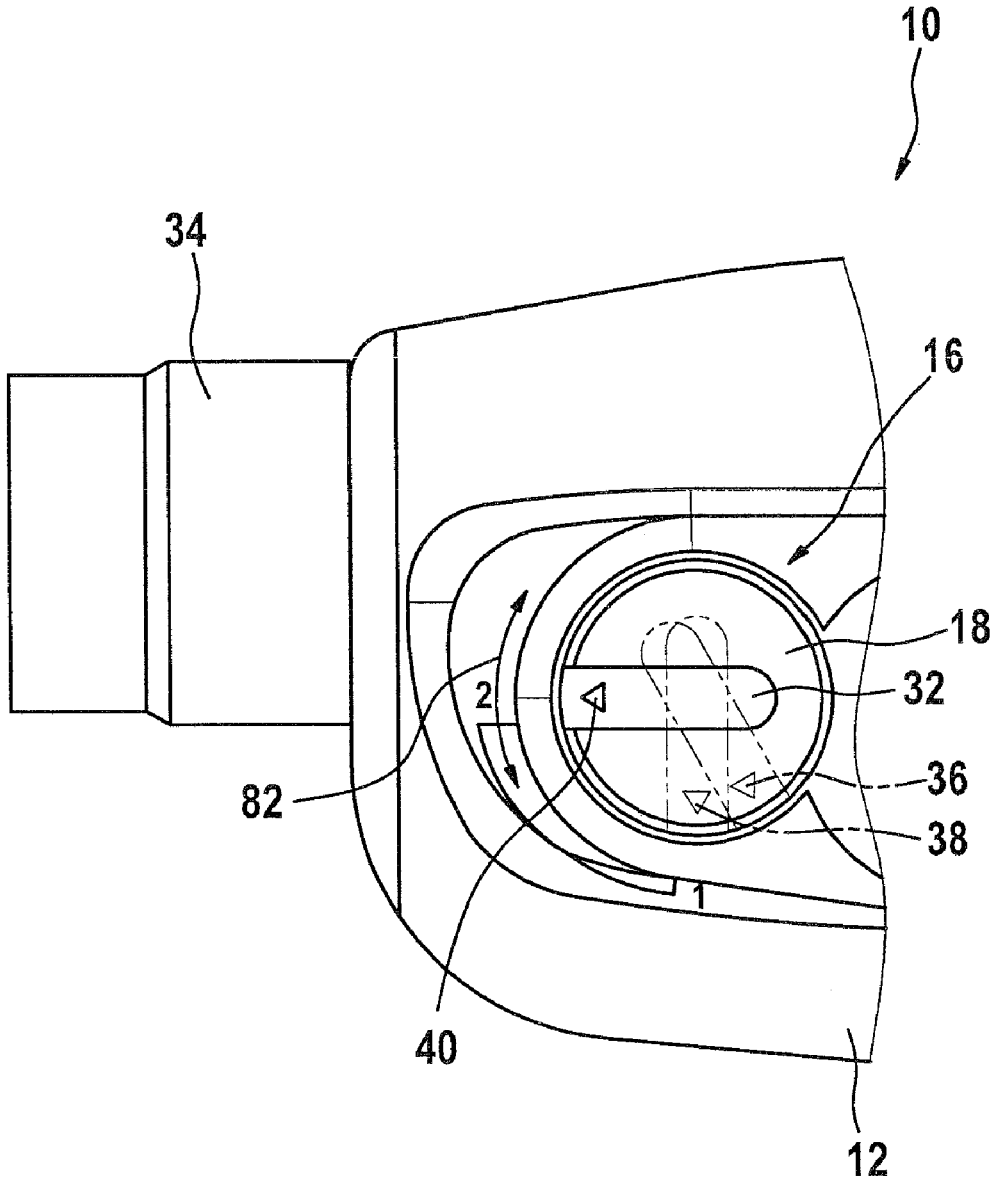
FIG. 1 shows a portion of a hand power tool of the invention, with a switch device.

In FIG. 1, a portion of a hand power tool 10, formed by a drill hammer, is shown. The hand power tool 10 includes a housing 12, and in a front region it has a tool insert receptacle 32 for receiving a tool. For switching among various gear speeds or different modes of operation and/or drive speeds of a tool located in the tool insert receptacle 34, the hand power tool 10 has a switch device 16, with an actuating unit 18 that includes a twist knob 32. The actuating unit 18 is shown in FIG. 1 in a mounting position 36 and in two different switching positions 38, 40.

Figure 2:
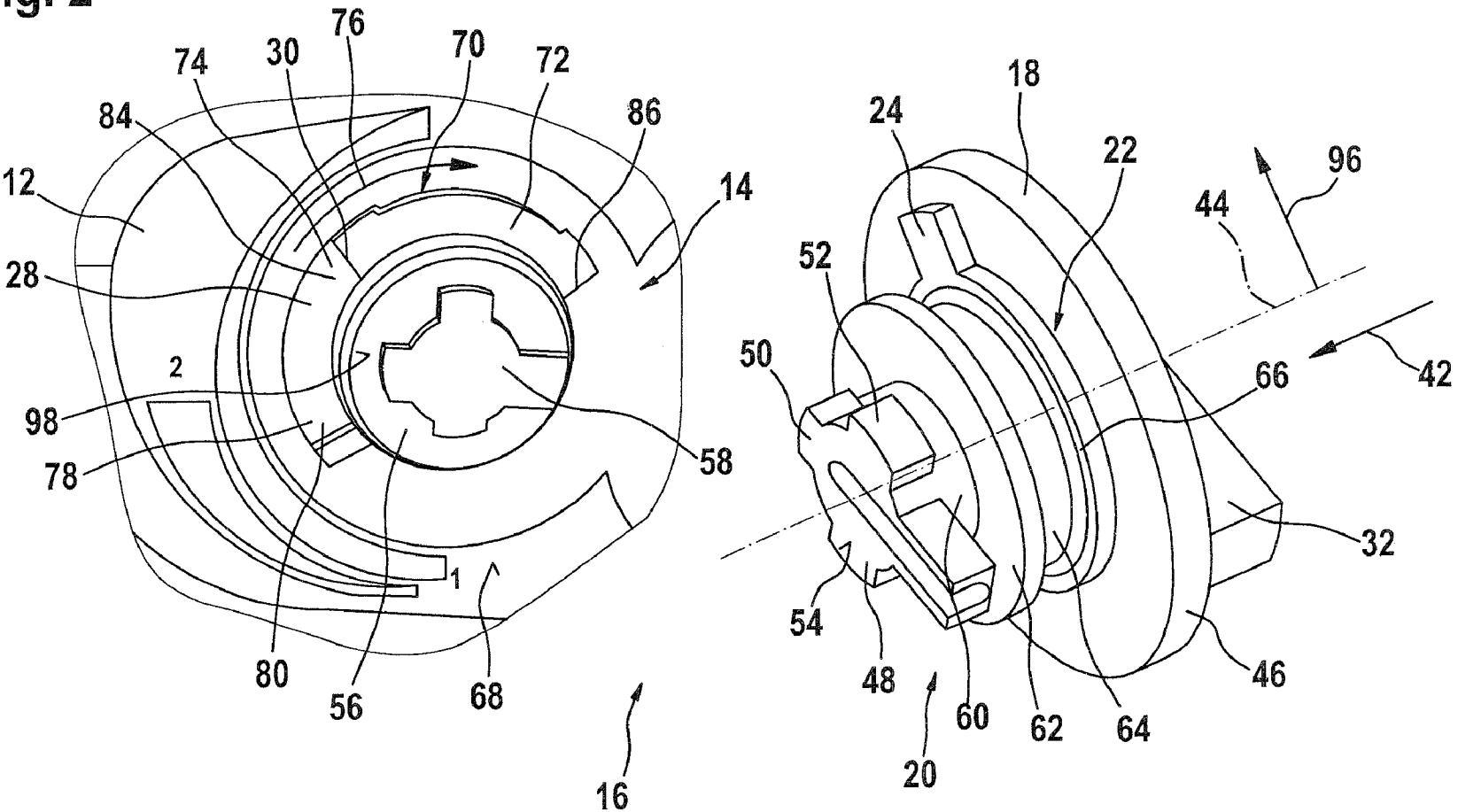
FIG. 2 shows a first joining unit of a housing and a second joining unit of an actuating unit, in an exploded view in perspective.
Figure 3:
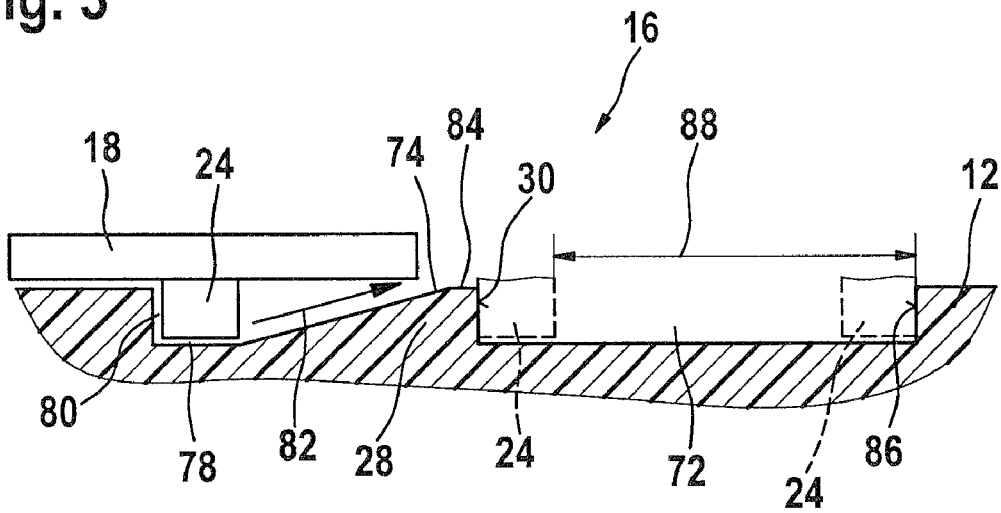
FIG. 3 shows the first and second joining units in a two-dimensional projection.

In FIGS. 2 and 3, the switch device 16 is shown with the actuating unit 18 and the housing 12 of the hand power tool 10. A first joining unit 14 is located on the housing 12 of the hand power tool 10 and is intended for receiving the actuating unit 18. The actuating unit 18, in an axial direction 42 that is oriented from the outside inward parallel to a pivot axis 44 of the actuating unit 18, has the twist knob 32 and adjoining it a covering disk 46. On a side of the covering disk 46 facing away from the twist knob 32, the actuating unit 18 includes a second joining unit 20.

By means of the first joining unit 14 and the second joining unit 20, the actuating unit 18 can be introduced without tools into a first position, formed by the mounting position 36. To that end, the second joining unit 20 has a key-contour element 48 in the axial direction 42, on an end 50 of the actuating unit 18 facing away from the twist knob 32. The key-contour element 48 of the actuating unit 18 includes a contoured disk 52 shaped like a cross, with a contoured face 54 embodied perpendicular to the pivot axis 44. Upon installation of the actuating unit 18, or in the mounting position 36, the key-contour element 48 of the actuating unit 18 engages a key-contour element 56 of the first joining unit 14. To that end, the key-contour element 56 of the first joining unit 14 is disk-shaped, with a recess 58 (FIG. 2) corresponding to the key-contour element 48 of the actuating unit 18.

The key-contour element 48 of the actuating unit 18 is adjoined, counter to the axial direction 42, by a cylindrical portion 60, whose length in the axial direction 42 is adapted to a thickness of the disklike embodiment of the key-contour element 56 of the first joining unit 14. The portion 60 has a smaller diameter than the key-contour element 48. The cylindrical portion 60 is adjoined, in a direction of the twist knob 32, by a stop disk 62, which in an installed position of the actuating unit 18 rests on the disklike key-contour element 56 of the first joining unit 14. The stop disk 62 has a diameter that is equal to the diameter of the disklike embodiment of the key-contour element 56 of the first joining unit 14 and is smaller than a diameter of the covering disk 46. Between the stop disk 62 of the actuating unit 18 and the covering disk 46, there is a further cylindrical portion 64, with a smaller diameter than the stop disk 62, and a locking unit 22 is located on the end of this cylindrical portion facing toward the covering disk 46. The locking unit 22 of the second joining unit 20 includes an annular element 66 with a boltlike locking element 24, which extends outward in a radial direction 96 on the annular element 66 (FIG. 2).

On the housing 12 of the hand power tool 10, the first joining unit 14 is countersunk relative to a surface 68 of the housing 12. The first joining unit 14 includes a locking unit 70 and the key-contour element 56. The locking unit 70 has a locking element 28 and a guide element 72 for guiding the locking element 24 of the second joining unit 20 in the various switching positions 38, 40. The locking element 28 is formed by a locking ramp 74, which upon mounting of the actuating unit 18 onto the housing 12 of the hand power tool 10 enables the locking element 24 of the second joining unit 20 to snap into the first switching position 38 and in particular prevents a backward motion of the actuating unit 18 or locking element 24 from the switching position 38 to the mounting position 36 (FIGS. 2 and 3) unless tools are used.

The guide element 72, together with the locking element 28, is located around the key-contour element 56 in a circumferential direction 76; the key-contour element 56 is countersunk on the housing 12 of the hand power tool 10, compared to the guide element 72 and the locking element 28. When the actuating unit 16 has been installed, the key-contour element 48 of the second joining unit 20 rests, in the axial direction 42 downstream of the key-contour element 56 of the first joining unit 14, on the same on an inside of the housing, and the stop disk 62 of the second joining unit 20 rests on an outer surface 98 of the key-contour element 56 of the first joining unit 14.

For assembly of the actuating unit 18 and the housing 12 of the hand power tool 10, the actuating unit 18 is introduced, with the key-contour element 48 of the second joining unit 20 leading, into the key-contour element 56 of the first joining unit 14 in the mounting position 36. The locking element 24 of the second joining unit 20 is located at that time inside a receiving region 78, on an end 80 of the locking ramp 74 facing away from the guide element 72, as can be seen in FIG. 3 from a projection of the first and second joining units 14, 20. By means of rotation in a rotary direction 82 (FIG. 1) of the actuating unit 18 from the mounting position 36 to the first switching position 38, the two key-contour elements 48, 56 are rotated relative to one another, so that portions of the two key-contour elements 48, 56 rest on one another, and a motion of the actuating unit 18 counter to the axial direction 42 is prevented.

The actuating unit 18, that is, the key-contour element 48 of the actuating unit 18, together with the key-contour element 56 of the first joining unit 14, secures the actuating unit 18 against falling out of the housing 12 of the hand power tool 10. Simultaneously, by the rotation of the actuating unit 18 from the mounting position 36 to the first switching position 38, the locking element 24 of the actuating unit 18 is moved, counter to the locking ramp 74 of the first joining unit 14, in the direction of rotation 82 about the pivot axis 44 of the actuating unit 18. Once the first switching position 38 is reached, the locking element 24 of the second joining unit 20 snaps into the guide element 72 of the first joining unit 14.

A backward motion of the actuating unit 18 to the mounting position 36 is prevented by a stop means 30 of the locking unit 70, so that by means of the two key-contour elements 48, 56, the actuating unit 18 is secured against being removed without tools by a user of the hand power tool 10. The stop means 30 is embodied in one piece with a ramplike step 84 of the locking element 28 of the first joining unit 14 (FIGS. 2 and 3).

The guide element 72 of the first joining unit 14 is provided for guiding the locking element 24 of the second joining unit 20 during switching between various gear speeds. To that end, the guide element 72 is limited by two stop means 30, 86 of the locking unit 70 along a switching path 88 between the two switching positions 38, 40, so that the locking element 24 of the second joining unit 20, during switching or rotation of the actuating unit 18 by a user, moves in the direction of rotation 82 only between the two switching positions 38, 40 (FIG. 3).

Figure 4:
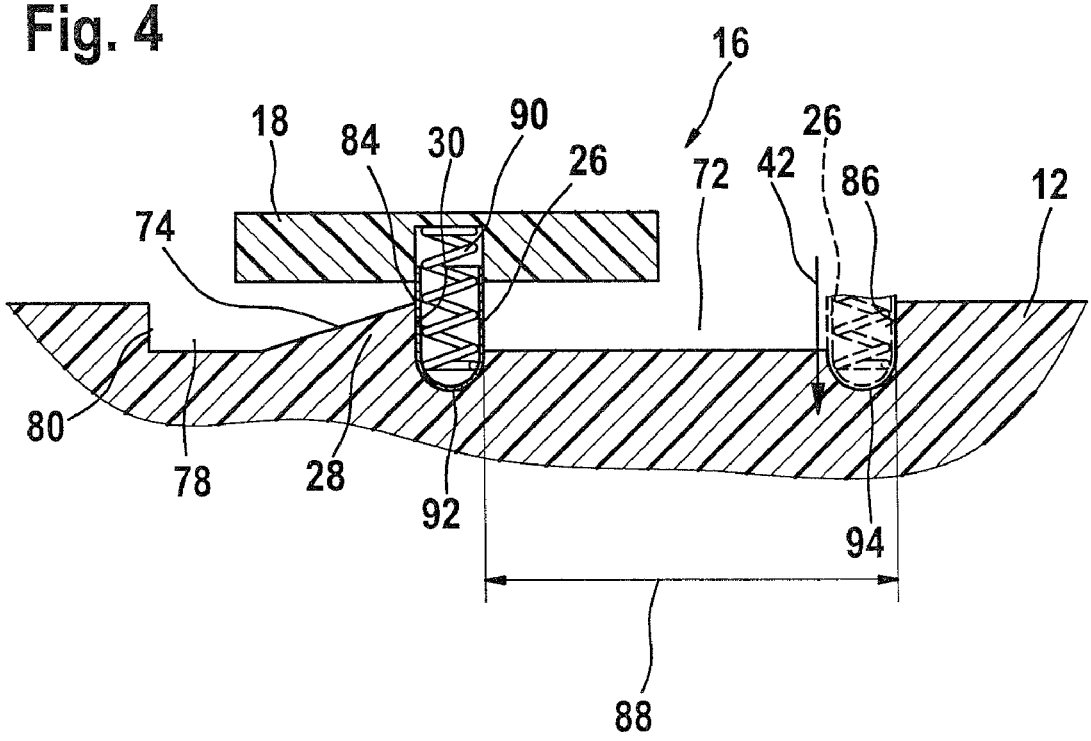
FIG. 4 shows an alternative embodiment of the first and second joining units in a two-dimensional projection.

In FIG. 4, a switch device 16 is shown that is an alternative to FIGS. 2 and 3. The description of this exemplary embodiment will be limited to differences from the exemplary embodiment shown in FIGS. 2 and 3. For characteristics that remain the same, the description of the exemplary embodiment of FIGS. 2 and 3 may be referred to. Analogous characteristics of the various exemplary embodiments are identified by the same reference numerals.

An actuating unit 18 of the switch device 16 includes a second joining unit 20 and a locking unit 22. The locking unit 22 has a locking element 26, which is elastically deflectable in an axial direction 42 by means of a spring element 90. Thus the locking element 26, in a first and a second switching position 38, 40, snaps in each case into a respective indentation 92, 94 in a guide element 72 of a first joining unit 14, so that the actuating unit 18 and the locking element 26 are secured stably in the respective switching position 38, 40. Upon shifting or rotation of the actuating unit 18 in a direction 82 of rotation from a switching position 38, 40 to the other switching position 38, 40, a user of the hand power tool 10 must exert a force to overcome a spring force of the spring element 90 if the locking element 26 is to be moved out of the respective indentation 92, 94.

It will be understood that each of the elements described above, or two or more together, may also find a useful application in other types of constructions differing from the type described above.

While the invention has been illustrated and described as embodied in a hand power tool, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hand power tool, comprising a housing; a first joining unit exposed to an outside of said housing; a switch device that has an actuating unit with a second joining unit corresponding to said first joining unit, said actuating unit with said second joining unit is movable relative to said first joining unit in an axial direction and pivotable relative to said first joining unit in a circumferential direction, said first joining unit and said actuating unit with said second joining unit being formed so that they define a single mounting position in the circumferential direction used solely for installation or removal of said actuating unit, said actuating unit being introducible in the axial direction without tools by said second joining unit into said first joining unit without opening said housing in said mounting position used solely for installation or removal of said actuating unit, which mounting position differs from at least one further switching position which is spaced from said single mounting position in the circumferential direction, so that the actuating unit exclusively in the mounting position can be mounted and dismounted from outside of the housing without opening said housing, said first joining unit and said second joining unit of said actuating unit being such that said actuating unit in an installed state of said actuating unit in said at least one further switching position is secured against being detached or removed without tools.

2. A hand power tool as defined in claim 1, wherein said actuating unit has a twist knob.

3. A hand power tool as defined in claim 1, wherein the hand power tool is configured as a hand power tool selected from the group consisting of a drill hammer, a chisel hammer, and both.

4. A hand power tool as defined in claim 1, wherein said first and second joining units have key-contour elements which are engagable into one another only in said single mounting position.

5. A hand power tool as defined in claim 4, wherein one of said key-contour elements is formed as a recess, while the other of said key contour elements is formed as a projection engaging in said recess.

6. A hand power tool, comprising a housing; a first joining unit exposed to an outside of said housing; a switch device that has an actuating unit with a second joining unit corresponding to said first joining unit, said actuating unit with said second joining unit is movable relative to said first joining unit in an axial direction and pivotable relative to said first joining unit in a circumferential direction, said first joining unit and said actuating unit with said second joining unit being formed so that they define a single mounting position in the circumferential direction used solely for installation or removal of said actuating unit, said actuating unit being introducible in the axial direction without tools by said second joining unit into said first joining unit without opening said housing in said mounting position used solely for installation or removal of said actuating unit, which mounting position differs from at least one further switching position which is spaced from said single mounting position in the circumferential direction, so that the actuating unit exclusively in the mounting position can be mounted and dismounted from outside of the housing without opening said housing, said first joining unit and said second joining unit of said actuating unit being such that said actuating unit in an installed state of said actuating unit in said at least one further switching position is secured against being detached or removed without tools, wherein said joining units have at least one locking unit which, in said at least one further switching position of said actuating unit differing from said mounting position, secures said actuating unit against moving into said mounting position.

7. A hand power tool as defined in claim 6, wherein said locking unit has at least one locking element which is configured as a bolt-shaped locking element.

8. A hand power tool as defined in claim 6, wherein said locking unit has at least one locking element which is elastically deflectable.

9. A hand power tool as defined in claim 6, wherein said locking unit has at least one locking element which is configured as a ramp-shaped locking element.

10. A hand power tool as defined in claim 6, wherein said locking unit has at least one stop means which is configured for locking said actuating unit in at least one switching position.

11. A hand power tool as defined in claim 10, wherein said at least one locking unit has at least one locking element, said stop means and said at least one locking element being formed in one piece with one another.

12. A hand power tool, comprising a housing; a first joining unit exposed to an outside of said housing; a switch device that has an actuating unit with a second joining unit corresponding to said first joining unit, said actuating unit with said second joining unit is movable relative to said first joining unit in an axial direction and pivotable relative to said first joining unit in a circumferential direction, said first joining unit and said actuating unit with said second joining unit being formed so that they define a single mounting position in the circumferential direction used solely for installation or removal of said actuating unit, said actuating unit being introducible in the axial direction without tools by said second joining unit into said first joining unit without opening said housing in said mounting position used solely for installation or removal of said actuating unit, which mounting position differs from at least one further switching position which is spaced from said single mounting position in the circumferential direction, so that the actuating unit exclusively in the mounting position can be mounted and dismounted from outside of the housing, said first joining unit and said second joining unit of said actuating unit being such that said actuating unit in an installed state of said actuating unit in said at least one further switching position is secured against being detached or removed without tools wherein said joining units have at least one locking unit which, in said at least one further switching position of said actuating unit differing from said mounting position, secures said actuating unit against moving into said mounting position and wherein said actuating unit has a pivot axis and is pivotable in the circumferential direction about said pivot axis, and wherein said at least one further switching position of said actuating unit is offset from said mounting position of said actuating unit in a direction of rotation of said actuating unit about said pivot axis.

* * * * *